US009454101B2

(12) United States Patent
Mori

(10) Patent No.: US 9,454,101 B2
(45) Date of Patent: Sep. 27, 2016

(54) DEVELOPING CARTRIDGE AND METHOD FOR MANUFACTURING THE SAME

(71) Applicant: Brother Kogyo Kabushiki Kaisha, Nagoya-shi, Aichi-ken (JP)

(72) Inventor: Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/466,387

(22) Filed: Aug. 22, 2014

(65) Prior Publication Data

US 2014/0363199 A1 Dec. 11, 2014

Related U.S. Application Data

(63) Continuation of application No. 12/976,926, filed on Dec. 22, 2010, now Pat. No. 8,818,247.

(30) Foreign Application Priority Data

Dec. 25, 2009 (JP) ..... 2009-294585
Dec. 25, 2009 (JP) ..... 2009-294586
Dec. 25, 2009 (JP) ..... 2009-294589

(51) Int. Cl.
*G03G 15/08* (2006.01)
*G03G 21/18* (2006.01)
*G03G 21/16* (2006.01)

(52) U.S. Cl.
CPC ..... *G03G 15/0896* (2013.01); *G03G 15/0865* (2013.01); *G03G 21/1676* (2013.01);
(Continued)

(58) Field of Classification Search
USPC ..... 399/119, 284
See application file for complete search history.

(56) References Cited

U.S. PATENT DOCUMENTS 5,930,565 A 7/1999 Doi et al.
7,336,913 B2 2/2008 Sato et al.
(Continued)

FOREIGN PATENT DOCUMENTS

CN 1728011 A 2/2006
CN 101487999 A 7/2009
(Continued)

OTHER PUBLICATIONS

Oct. 22, 2013—(JP) Notification of Reason for Refusal—App 2009-294586.
(Continued)

*Primary Examiner* — David Gray
*Assistant Examiner* — Sevan A Aydin
(74) *Attorney, Agent, or Firm* — Banner & Witcoff, Ltd.

(57) ABSTRACT

A developing cartridge is provided. The developing cartridge includes a first frame and a second frame and a layer thickness regulating member. The first frame and the second frame include a first welding surface formed at a periphery of the developer accommodating part correspondingly to a developer accommodating part; and a second welding surface extending continuously from the first welding surface correspondingly to a roller support part. The first welding surface extends in a direction orthogonal to an overlapping direction of the first frame and the second frame. The second welding surface extends to be inclined toward a side of the first frame in the overlapping direction as extending toward the developing roller. The layer thickness regulating member is provided to cover the second welding surface from a side of the second frame in the overlapping direction.

10 Claims, 9 Drawing Sheets

(52) U.S. Cl.
CPC ..... *G03G21/1814* (2013.01); *G03G 21/1828* (2013.01); *G03G 2215/0636* (2013.01); *G03G 2221/1678* (2013.01); *G03G 2221/1815* (2013.01)

(56) References Cited

U.S. PATENT DOCUMENTS

| | | | |
|---|---|---|---|
| 8,170,442 | B2 | 5/2012 | Sato et al. |
| 2001/0033757 | A1 | 10/2001 | Sato |
| 2002/0098007 | A1 | 7/2002 | Chadani |
| 2003/0118364 | A1 | 6/2003 | Kamimura |
| 2006/0024085 | A1 | 2/2006 | Sato et al. |
| 2006/0133847 | A1 | 6/2006 | Burton |
| 2006/0171736 | A1 | 8/2006 | Okamoto et al. |
| 2009/0180816 | A1 | 7/2009 | Sato et al. |

FOREIGN PATENT DOCUMENTS

| | | | | |
|---|---|---|---|---|
| JP | 2002-207407 | A | | 7/2002 |
| JP | 2002-214896 | A | | 7/2002 |
| JP | 2002-214906 | A | | 7/2002 |
| JP | 2003162147 | A | * | 6/2003 ..... G03G 15/08 |
| JP | 2004-302333 | A | | 10/2004 |
| JP | 2006-039430 | A | | 2/2006 |
| JP | 2006-208689 | A | | 8/2006 |
| JP | 2009-168993 | A | | 7/2009 |

OTHER PUBLICATIONS

Oct. 25, 2011—(JP) Notification of Reason for Refusal—App 2009-294585.

Apr. 26, 2012—(CN) Notice of First Office Action—App 201010623069.

Apr. 14, 2015—(US) Non-Final Office Action—U.S. Appl. No. 14/466,452.

Apr. 14, 2015—(US) Non-Final Office Action—U.S. Appl. No. 14/466,621.

Apr. 20, 2015—(US) Non-Final Office Action—U.S. Appl. No. 14/466,518.

Apr. 24, 2015—(US) Non-Final Office Action—U.S. Appl. No. 14/466,561.

Aug. 28, 2015—(US) Final Office Action—U.S. Appl. No. 14/466,452.

* cited by examiner

DEVELOPING CARTRIDGE AND METHOD FOR MANUFACTURING THE SAME

CROSS-REFERENCE TO RELATED APPLICATION

This application claims priority from U.S. patent application Ser. No. 12/976,926, filed Dec. 22, 2010, and from Japanese Patent Application Nos. 2009-294585, 2009-294586 and 2009-294589, filed on Dec. 25, 2009, the entire subject matter of which is incorporated herein by reference.

TECHNICAL FIELD

Aspects of the present invention relate to a developing cartridge that is provided to an image forming apparatus such as a laser printer and a method for manufacturing a developing cartridge.

BACKGROUND

As an image forming apparatus, there is known a printer including a process cartridge detachably provided thereto. The process cartridge includes a drum cartridge which supports a photosensitive drum and a developing cartridge which supports a developing roller and is detachably provided to the drum cartridge.

As the developing cartridge provided to the printer, there is suggested a developing cartridge including a lower frame which supports a developing roller, and an upper frame connected to the lower frame by welding (for example, refer to JP-A-2009-168993).

In the developing cartridge, the upper frame has a main body part having a plate shape and a beam part that is provided at a front end of the main body part, and a periphery of a lower surface of the main body part is formed with welding ribs that are welded on upper surfaces of a left-side wall part, a right-side wall part and a back-side wall part of the lower frame.

When the upper frame and the lower frame are connected, a front end of the beam part of the upper frame and front faces of the left-side wall part and right-side wall part of the lower frame configure a substantially same plane. A seal member is provided between the beam part of the upper frame and the left-side and right-side wall parts of the lower frame.

In the developing cartridge described in JP-A-2009-168993, the main body part of the upper frame and the left-side, right-side and back-side wall parts of the lower frame are welded. However, the beam part of the upper frame and the left-side and right-side wall parts of the lower frame are not welded each other.

Therefore, in order to seal a space between the beam part of the upper frame and the left-side and right-side wall parts of the lower frame, the seal member is inevitably provided, so that it is difficult to reduce the number of parts.

SUMMARY

Accordingly, an aspect of the present invention is to provide a developing cartridge which allows an image forming apparatus to be size-reduced and the number of parts to be reduced.

Another aspect of the present invention is to provide a developing cartridge which is capable of further preventing developer from being leaked and capable of reducing the number of parts.

According to an illustrative embodiment of the present invention, there is provided a developing cartridge comprising: a first frame including: a developer accommodating part which is configured to accommodate developer; and a roller support part which is provided adjacent to one side of the developer accommodating part, and which supports a developing roller at an end portion at a side opposite to the developer accommodating part; a second frame overlapped and welded with the first frame to cover the developer accommodating part and the roller support part; and a layer thickness regulating member which is provided to extend in an axial direction of the developing roller and is configured to regulate a thickness of developer carried on the developing roller, wherein each of the first frame and the second frame includes: an accommodating part side welding surface formed at a periphery of the developer accommodating part correspondingly to the developer accommodating part; and a support part side welding surface extending continuously from the accommodating part side welding surface correspondingly to the roller support part, wherein the accommodating part side welding surface extends in a direction orthogonal to an overlapping direction of the first frame and the second frame, wherein the support part side welding surface extends to be inclined toward a side of the first frame in the overlapping direction as extending toward the developing roller, and wherein the layer thickness regulating member is provided to cover the support part side welding surface from a side of the second frame in the overlapping direction.

According to another illustrative embodiment of the present invention, there is provided a developing cartridge comprising: a first frame including: a developer accommodating part which is configured to accommodate developer; and a roller support part which is provided adjacent to the developer accommodating part, and which supports a supply roller and a developing roller; a second frame connected with the first frame to cover the developer accommodating part and the roller support part; and a layer thickness regulating member which is provided to extend in an axial direction of the developing roller and is configured to regulate a thickness of developer carried on the developing roller, wherein each of the first frame and the second frame includes: a first surface formed at a periphery of the developer accommodating part; and a pair of second surfaces provided at an interval therebetween in the axial direction of the developing roller and extending continuously from the first surface and overlapped with the supply roller, as viewed in the axial direction of the developing roller, the first frame and the second frame being connected by the first surface and the second surfaces, wherein the first surface extends in a first direction, wherein the second surface extends continuously form the first surface in a second direction inclined with respect to the first direction, and wherein the layer thickness regulating member is provided to overlap the second surface in a direction orthogonal to the first direction and the axial direction of the developing roller.

According to a further illustrative embodiment of the present invention, there is provided a developing cartridge comprising: a first frame including: a developer accommodating part which is configured to accommodate developer; and a roller support part which is provided adjacent to one side of the developer accommodating part, and which supports a developing roller at an end portion at a side opposite to the developer accommodating part; a second frame overlapped and welded with the first frame to cover the developer accommodating part and the roller support part; and a layer thickness regulating member which is provided to extend in an axial direction of the developing roller and is configured to regulate a thickness of developer carried on the developing roller, wherein each of the first frame and the second frame includes: an accommodating part side welding surface formed at a periphery of the developer accommodating part correspondingly to the developer accommodating part; and a pair of support part side welding surfaces provided at an interval therebetween in the axial direction of the developing roller and extending continuously from the accommodating part side welding surface correspondingly to the roller support part, wherein the accommodating part side welding surface extends in a direction orthogonal to an overlapping direction of the first frame and the second frame, wherein the pair of support part side welding surfaces extend to be inclined toward a side of the first frame in the overlapping direction as extending toward the developing roller and are formed wider than a welding area where the first frame and the second frame are welded, and wherein either the first frame or the second frame includes a reinforcement part which is provided between the pair of support part side welding surfaces.

According to a further illustrative embodiment of the present invention, there is provided a developing cartridge comprising: a first frame including: a developer accommodating part which is configured to accommodate developer; and a carrier support part which is provided adjacent to the developer accommodating part and which supports a developer carrier configured to carry developer; and a second frame welded to the first frame so as to cover the developer accommodating part and the carrier support part, wherein the first frame includes a first welding surface to be welded with the second frame, at a periphery of the developer accommodating part and the carrier support part, and wherein the second frame includes a second welding surface corresponding to the first welding surface.

According to a further illustrative embodiment of the present invention, there is provided a method for manufacturing a developing cartridge including a developer accommodating part which is configured to accommodate developer, and a carrier support part which is provided adjacent to the developer accommodating part and which supports a developer carrier configured to carry developer; the method comprising: providing a first frame including a first welding surface which surrounds the developer accommodating part and the carrier support part, and a receiving part which is provided at an opposite side to the first welding surface in the carrier support part; providing a second frame including a second welding surface corresponding to the first welding surface, connecting the second frame to the first frame to cover the developer accommodating part and the carrier support part; and welding the connected first frame and the second frame while pressing the second frame toward the first frame in a state where the receiving part is put on a jig.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

1. Overall Structure of Printer

Figure 1:
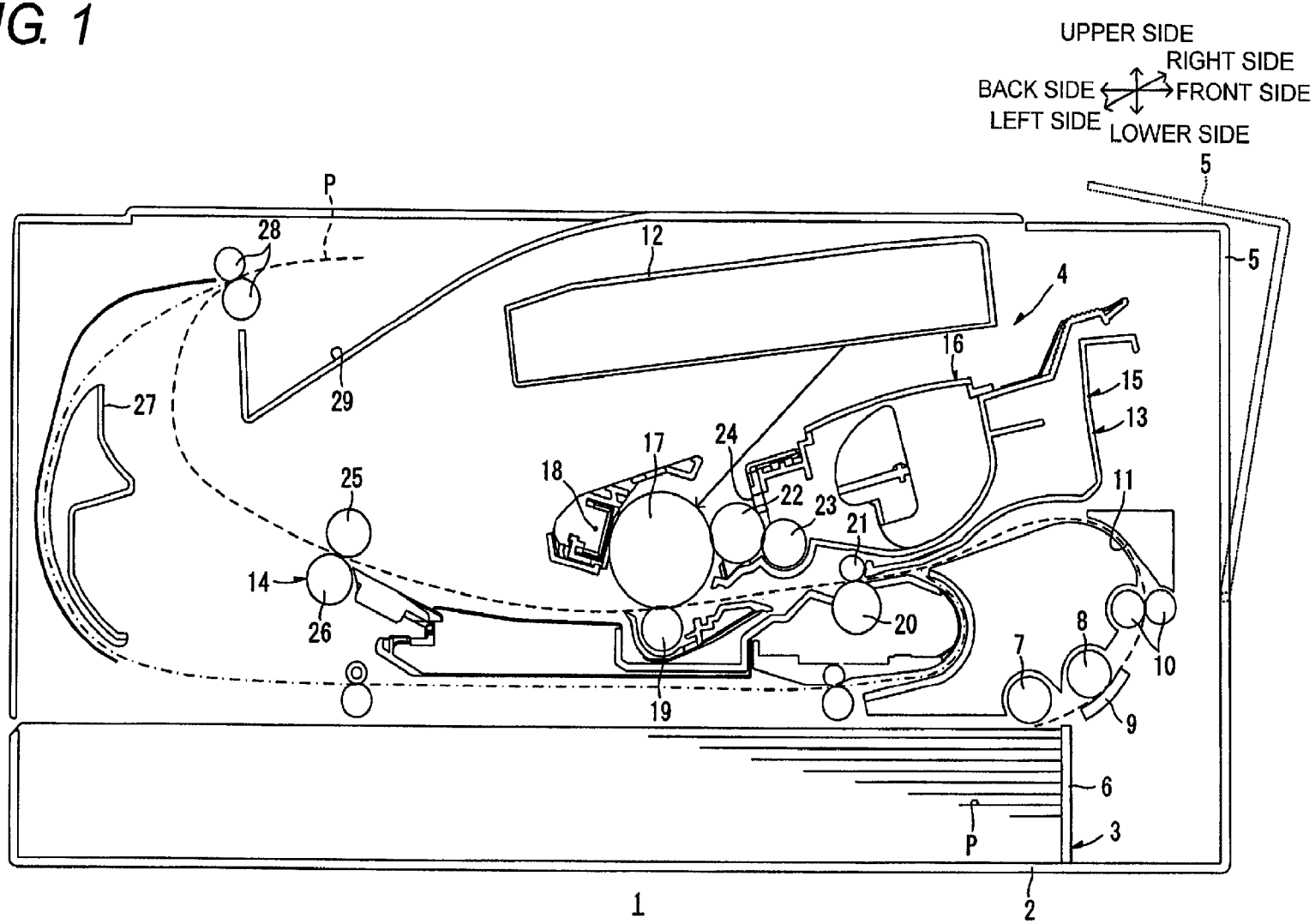
FIG. 1 is a side sectional view of a printer according to an illustrative embodiment.

As shown in FIG. 1, a printer 1 includes, in a body casing 2, a feeder unit 3 configured to feed a sheet P and an image forming unit 4 configured to form an image on the fed sheet P.

(1) Body Casing

The body casing 2 has a substantially rectangular box shape, when seen from a side face, and houses the feeder unit 3 and the image forming unit 4. The body casing 2 has a front cover 5 at one side wall thereof for mounting and removing a process cartridge 13 (described later). The front cover 5 is provided to the body casing 2 so as to be rotatable about a lower end portion as a support point.

In the below descriptions, a side (right side in FIG. 1) to which the front cover 5 is provided is referred to as the front side and an opposite side (left side in FIG. 1) is referred to as the back side. In addition, the left and the right are defined when seen from the front side of the printer 1. In other words, the front side of the drawing sheet of FIG. 1 is the left side and the back side of the drawing sheet of FIG. 1 is the right. Further, a left-right direction is parallel to an axial direction of a developing roller 22 (described later) and may be referred to as a width direction (2) Feeder Unit The feeder unit 3 is provided at a lower part of the body casing 2. The feeder unit 3 includes a sheet feeding tray 6 that receives sheets P, a pickup roller 7 that is provided above a front end portion of the sheet feeding tray 6 and a separation roller 8 and a separation pad 9 which are opposed to each other at the front side of the pickup roller 7. In addition, the feeder unit 3 has a pair of front and rear feeder rollers 10, which are opposed to each other above the separation pad 9, a sheet feeding path 11 that extends from the opposing area between both feeder rollers 10 in a substantially rear-upper direction and a main body-side register roller 20 that is provided at the rear of the sheet feeding path 11.

The sheets P are stacked in the sheet feeding tray 6. The uppermost sheet P is fed to the opposing area between the separation roller 8 and the separation pad 9 by rotation of the pickup roller 7. The sheets P are separated one-by-one by the separation roller 8 and the separation pad 9. Then, the sheet P passing through the sheet feeding path 11 by the feeder rollers 10 is conveyed between the main body-side register roller 20 and a process-side register roller 21 (described later) and is further conveyed toward between a photosensitive drum 17 (described later) and a transfer roller 19 (described later).

In the meantime, separately from the feeder unit 3, there is provided a sheet reverse mechanism that returns the sheet P from a sheet discharge path 27 (described later) toward between the main body-side register roller 20 and the process-side register roller 21 (described later) as indicated by the chain line in FIG. 1, so that a two-sided printing can be made in the printer 1.

(3) Image Forming Unit

The image forming unit 4 includes a scanner unit 12, a process cartridge 13 and a fixing unit 14.

(3-1) Scanner Unit

The scanner unit 12 is provided at an upper part of the body casing 2. The scanner unit 12 emits laser beam toward the photosensitive drum 17 (described later), based on image data, and thus exposes the photosensitive drum 17 (described later), as indicated by the solid line.

(3-2) Process Cartridge (3-2-1) Structure of Process Cartridge

The process cartridge 13 is detachably received at the lower part of the scanner unit 12 and at the upper part of the feeder unit 3 in the body casing 2. The process cartridge includes a drum cartridge 15 and a developing cartridge 16 that is detachably attached to the drum cartridge 15.

The drum cartridge 15 includes the photosensitive drum 17, a scorotron-type charger 18 and the transfer roller 19.

The photosensitive drum 17 is rotatably provided at a rear end portion of the drum cartridge 15 along the left-right direction. The scorotron-type charger 18 is provided to oppose the photosensitive drum 17 at an interval therebetween at the rear-upper side of the photosensitive drum 17.

The transfer roller 19 is provided to oppose the lower side of the photosensitive drum 17 and is press-contacted to the lower side of the photosensitive drum 17.

In addition, the drum cartridge 15 includes the process-side register roller 21. The process-side register roller 21 is provided to contact the upper of the main body-side register roller 20 at a lower part of a substantially center portion in the front-rear direction of the drum cartridge 15.

The developing cartridge 16 includes the developing roller 22 (an example of a developer carrier).

The developing roller 22 is rotatably supported by the developing cartridge 16 at the rear end portion thereof so as to be exposed from the rear side and is press-contacted to the front side of the photosensitive drum 17.

In addition, the developing cartridge 16 includes a supply roller 23 which is configured to supply toner (an example of developer) to the developing roller 22, and a layer thickness regulating blade 24 (an example of a layer thickness regulating member) which is configured to regulate a thickness of toner supplied on the developing roller 22. Toner is accommodated in a front space of the supply roller 23 and the layer thickness regulating blade 24.

(3-2-3) Developing Operation in Process Cartridge

When forming an image, toner in the developing cartridge 16 is supplied to the supply roller 23 and further to the developing roller 22 and is positively friction-charged between the supply roller 23 and the developing roller 22.

A thickness of toner supplied on the developing roller 22 is regulated by the layer thickness regulating blade 24 as the developing roller 22 is rotated, and the toner is carried on the surface of the developing roller 22 as a thin layer having a predetermined thickness.

In the meantime, a surface of the photosensitive drum 17 is positively and uniformly charged by the scorotron-type charger 18 as the photosensitive drum 17 is rotated and is then exposed by high-speed scanning of the laser beam from the scanner unit 12 (refer to the solid line in FIG. 1). Accordingly, an electrostatic latent image that corresponds to an image to be formed on the sheet P is formed on the surface of the photosensitive drum 17.

When the photosensitive drum 17 is further rotated, the positively charged toner, which is carried on the surface of the developing roller 22, is supplied to the electrostatic latent image formed on the surface of the photosensitive drum 17. Accordingly, the electrostatic latent image of the photosensitive drum 17 becomes a visible image and a toner image resulting from reversal development is carried on the surface of the photosensitive drum 17.

When the sheet P conveyed between the photosensitive drum 17 and the transfer roller 19 is passing through between the photosensitive drum 17 and the transfer roller 19, the toner image carried on the photosensitive drum 17 is transferred onto the sheet P.

(3-3) Fixing Unit

The fixing unit 14 is provided at the rear of the process cartridge 13. The fixing unit 14 includes a heating roller 25 and a pressing roller 26 that is opposed to the heating roller 25. The toner image transferred on the sheet P in the process cartridge 13 is heat-fixed on the sheet P by heating and pressing while the sheet P passes through between the heating roller 25 and the pressing roller 26.

(4) Sheet Discharge Unit

The sheet P on which the toner image is fixed passes through the sheet discharge path 27 is conveyed toward the sheet discharge roller 28 and is discharged on a sheet discharge tray 29 by a sheet discharge roller 28. The sheet discharge tray 29 is provided at the upper side of the scanner unit 12.

2. Details of Developing Cartridge (1) Frame

Figure 2:
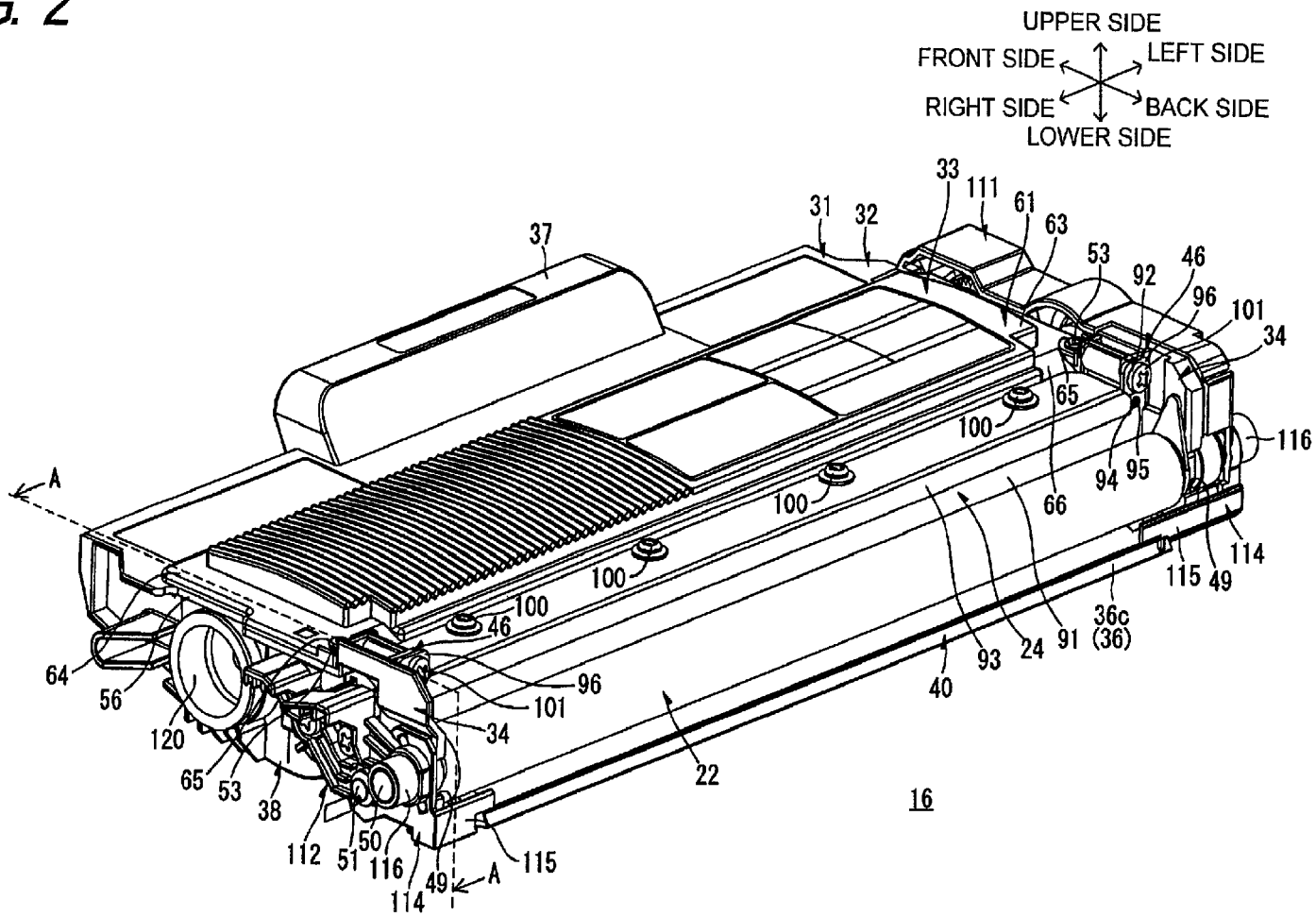
FIG. 2 is a perspective view of a developing cartridge shown in FIG. 1, as seen from a right-upper side.
Figure 3:
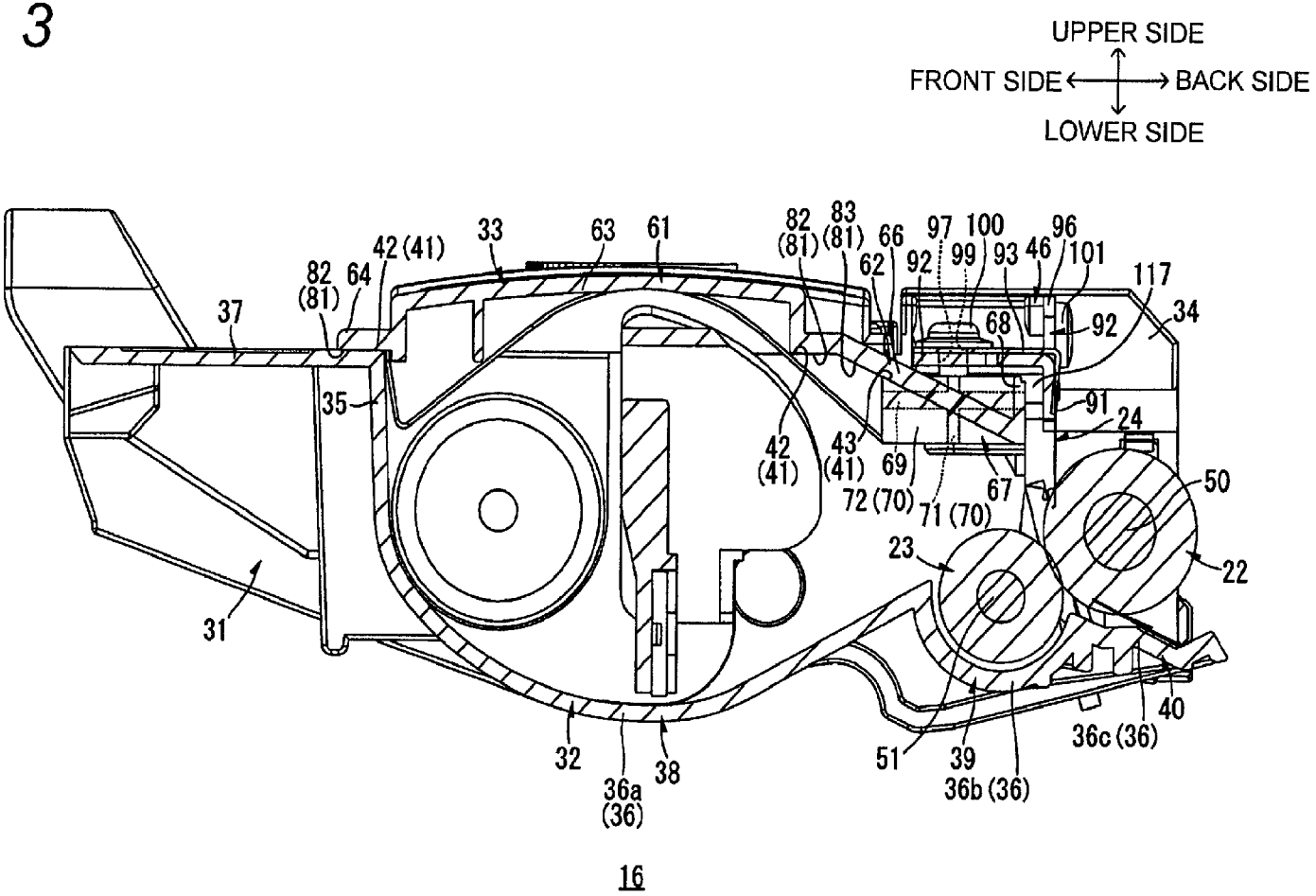
FIG. 3 is a side sectional view of the developing cartridge shown in FIG. 1.

As shown in FIGS. 2 and 3, the developing cartridge 16 has a substantially box shape extending in the left-right direction, and has a frame 31.

The frame 31 has a substantially box shape extending in the left-right direction, and includes a first frame 32 and a second frame 33.

(1-1) First Frame (1-1-1) Structure of First Frame

Figure 4:
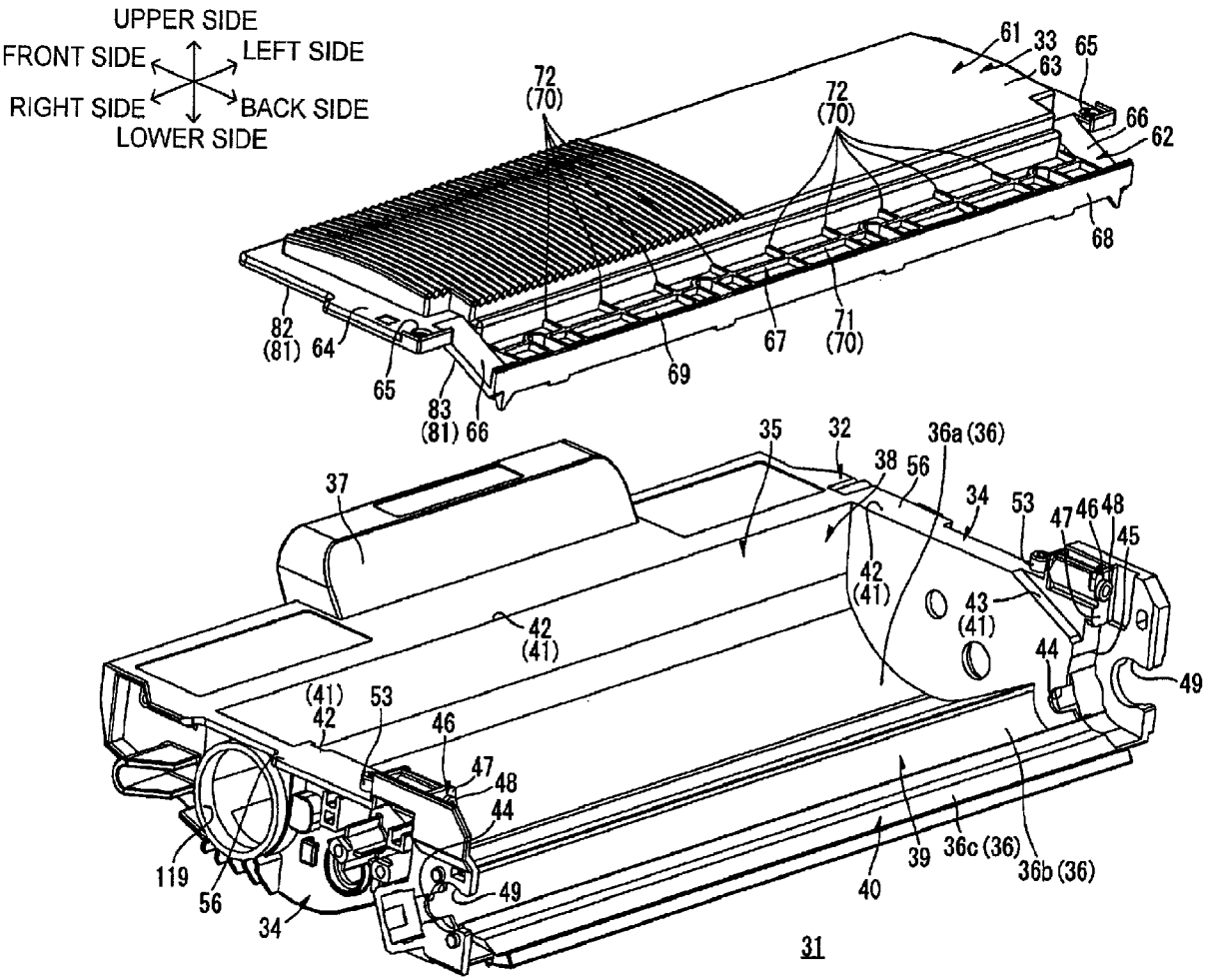
FIG. 4 is an exploded perspective view of a frame shown in FIG. 2, as seen from a right-upper side.

As shown in FIG. 4, the first frame 32 configures a lower side of the frame 31 and is opened upward and rearward and has a bottom. The first frame 32 integrally has a pair of sidewalls 34, a front wall 35 and a lower wall 36.

Each of the sidewalls 34 has a substantially rectangular shape extending in the front-rear direction, when seen from a side face, and is opposed to each other at an interval in the left-right direction. In addition, the right sidewall 34 is formed with a toner filling opening 119 that penetrates the sidewall 34 in the left-right direction at a position corresponding to a toner accommodating part 38 (described later).

The front wall 35 has a substantially rectangular shape extending in the left-right direction, when seen from a front face, and is built between front end portions of both sidewalls 34. In addition, the front wall 35 has an operation part 37 that extends to the front from an upper end portion of the front wall. The operation unit 37 is held by a user when the user operates the developing drum 16 (for example, attachment and detachment operation to and from the drum cartridge 15).

The lower wall 36 is continued to a lower end portion of the front wall 35 and is extended rearward from the lower end portion of the front wall 35 between lower end portions of both sidewalls 34. In addition, the lower wall 36 integrally has a first part **36*a* that configures the toner accommodating part 38 (described later), a second part 36***b* that configures a supply roller support part 39 (described later) and a third part 36*c* that configures a developing roller support part 40 (described later).

The first part 36*a* is provided at a substantially center of the first frame 32 in the front-rear direction, and has a gentle circular arc shape having an opened upper side when seen from a side sectional view thereof. Specifically, the first part 36*a* is formed such that it is continued from the lower end portion of the front wall 35, is bent rearward toward the lower and is then inclined slightly upward toward the rear.

The second part 36*b* has a substantially U-shape having an opened upper side when seen from a side sectional view such that it is continued from a rear end portion of the first part 36*a* and is bent along a circumferential surface of the supply roller 23.

The third part 36*c* has a substantially linear shape (rib shape) that is continued from a rear end portion of the second part 36*b* and extends rearward from the rear end portion, when seen from a side sectional view.

A part surrounded by the sidewalls 34, the front wall 35 and the first part 36*a* is defined as the toner accommodating part 38 in which toner is accommodated. In the toner accommodating part 38, an upper end surface of the front wall 35 is formed into a surface that is substantially flush with upper end surfaces of the sidewalls 34. In addition, the toner accommodating part 38 has flange parts 56 and second frame positioning bosses 53.

The flange parts 56 respectively have a plate shape extending in the front-rear direction so that they are outwardly protruded in the left-right direction from upper edges of the sidewalls 34 of the toner accommodating part 38.

The second frame positioning bosses 53 respectively have a substantially cylindrical shape protruding upward from the upper end surfaces of the sidewalls 34 and the flange parts 56 at the rear end portions of the toner accommodating part 38.

In addition, a part surrounded by the sidewalls 34 and the second part 36*b* is defined as the supply roller support part 39. The supply roller support part 39 is formed with step portions 45 and supply roller support recesses 44.

The step portion 45 is formed such that a rear half part thereof is outwardly recessed in the left-right direction regarding a front half part thereof at a substantially center of the sidewall 34 in the supply roller support part 39 in of the front-rear direction. In addition, a lower end portion of the step portion 45 is bent rearward toward the lower so as to correspond to a circumferential surface of the developing roller 22. In addition, a blade fixing part 46 (an example of a fixing part) is provided to an upper end portion of the step portion 45.

The blade fixing part 46 has a substantially rectangular shape slightly protruding toward the rear from a rear end surface of the step portion 45 at an outward half part of the left-right direction of the sidewall 34, when seen from a front face. In addition, the blade fixing part 46 has a support surface 47 extending in the upper-lower direction and a blade positioning boss 48 protruding from the support surface 47 toward the rear. The blade positioning boss 48 has a substantially cylindrical shape to which a screw 101 (which will be described later) can be engaged.

The supply roller support recess 44 is recessed into a substantially U-shape from a rear end surface toward a front-lower side at the lower end portion of the step portion 45, when seen from a side face that is opened in a rear-upper direction. A recess width of the supply roller support recess 44 (a length in the front-upper and the rear-lower direction) is formed to be wider than a diameter of a supply roller axis 51 of the supply roller 23.

In addition, a part surrounded by the sidewalls 34 and the third part 36*c* is defined as the developing roller support part 40. The developing roller support part 40 is defined as a roller support part (an example of a carrier support part) together with the supply roller support part 39. In other words, the roller support part is provided adjacent to the rear of the toner accommodating part 38. In addition, the sidewalls 34 of the developing roller support part 40 are continued to the back side half parts of the sidewalls 34 of the supply roller support part 39 and formed to have a thickness (a length of the left-right direction) same as the back side half parts of the sidewalls 34 of the supply roller support part 39. The sidewalls 34 of the developing roller support part 40 are formed with developing roller support recesses 49.

The developing roller support recess 49 is recessed from the rear end portion of the sidewall 34 toward the front side into a substantially U-shape that is opened rearward, when seen from a side. A recess width (a length of the upper-lower direction) of the developing roller support recess 49 is formed to be wider than a diameter of a developing roller axis 50 of the developing roller 22.

(1-1-2) Structure Related to Welding in First Frame

The first frame 32 includes a first welding surface 41.

The first welding surface 41 is configured by the upper surfaces of the sidewalls 34 and the upper surface of the front wall 35 and includes a first accommodating part side welding surface 42 and a pair of first support part side welding surfaces 43. The first accommodating part side welding surface 42 includes the upper surface of the front wall 35 and the upper surfaces of the sidewalls 34 corresponding to the toner accommodating part 38. In other words, the first accommodating part side welding surface 42 is defined into a substantial U-shape having an opened rear side at the periphery of the toner accommodating part 38, when seen from a plan view, so as to correspond to the toner accommodating part 38.

The first support part side welding surfaces 43 are continued from the rear end portions of the first accommodating part side welding surface 42 and are respectively defined as inner half parts of the upper end surfaces of the sidewalls 34 in the left-right direction (i.e., inner sides of the left-right direction with respect to the blade fixing parts 46). In addition, the first support side welding surfaces 43 are extended to the substantially centers of the supply roller support part 39 in the front-rear direction to be inclined downwardly toward the rear. In other words, each of the first support side welding surfaces 43 is formed at the circumference of the supply roller support part 39 so as to correspond to the supply roller support part 39. Additionally, the rear end portion of the first support side welding surface 43 is provided between the blade fixing part 46 and the supply roller support recess 44 in the upper-lower direction.

Figure 5:
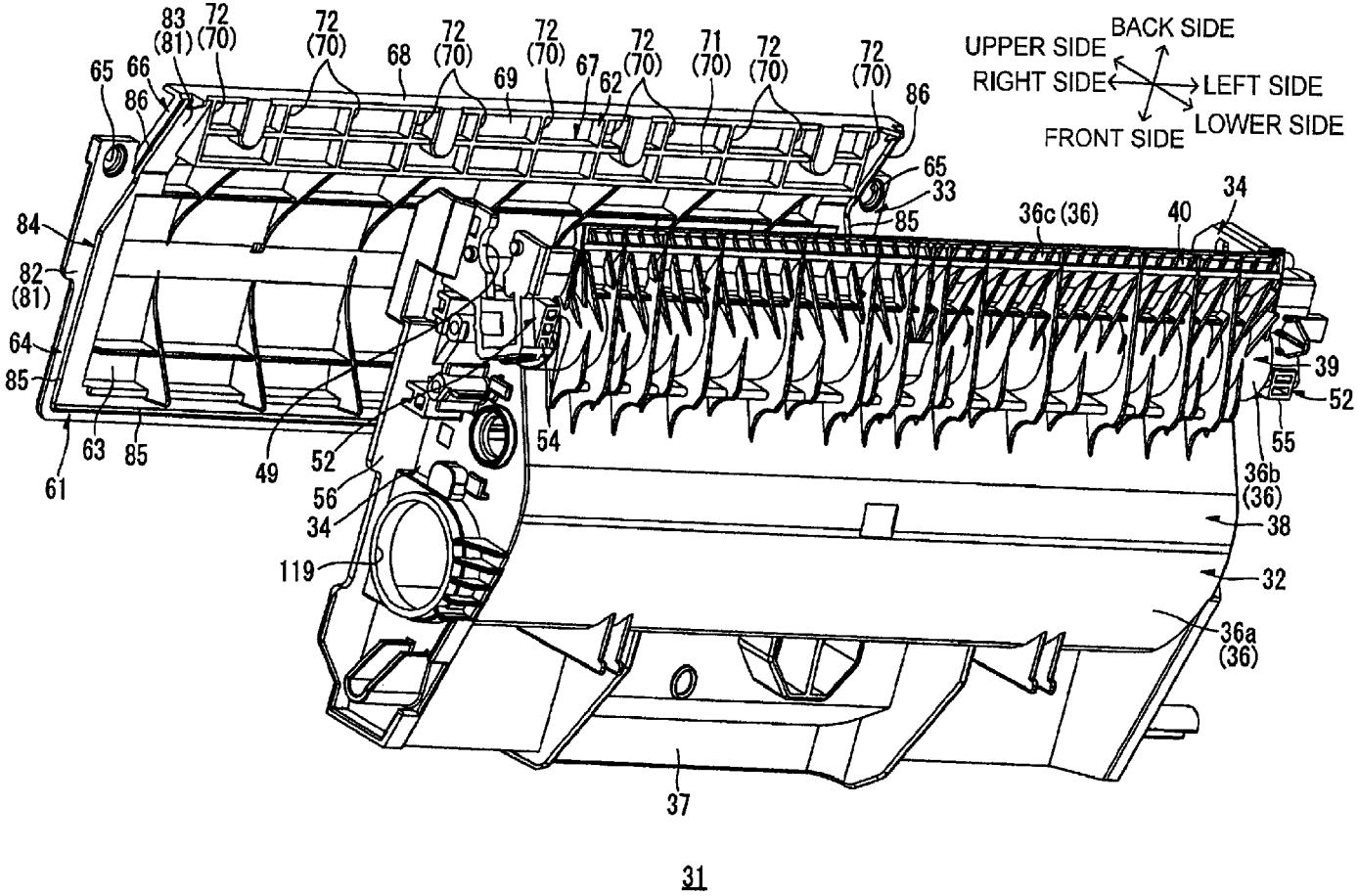
FIG. 5 is an exploded perspective view of the frame shown in FIG. 2 as seen from a right-lower side.
Figure 6:
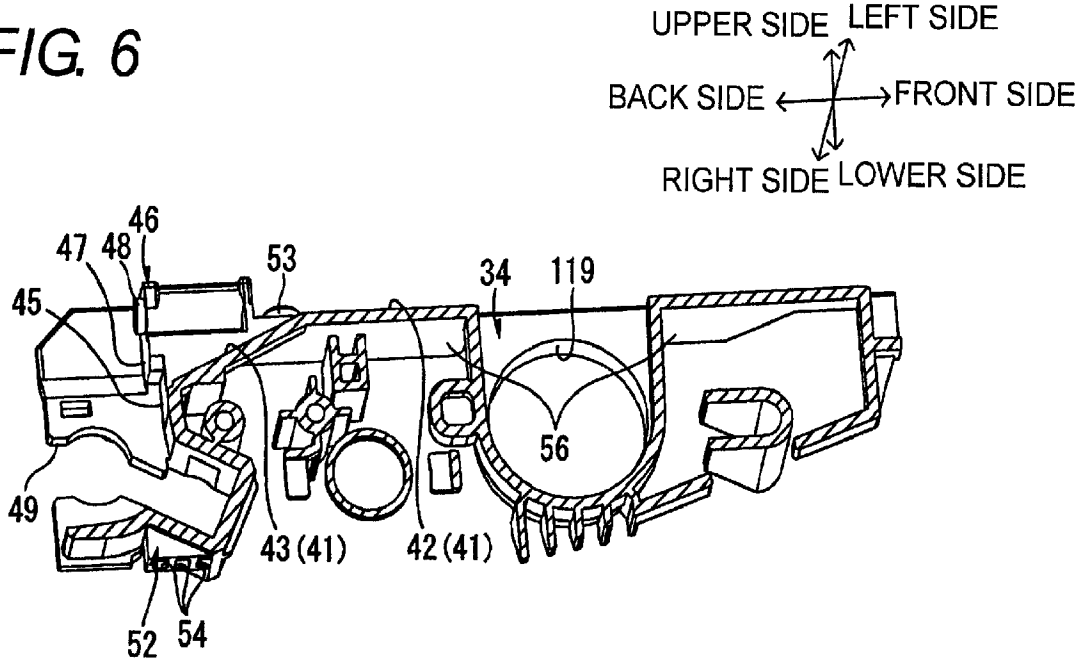
FIG. 6 is a sectional view of the frame shown in FIG. 2, taken along a line A-A.

The first frame 32 includes receiving parts 52, as shown in FIGS. 5 and 6.

The receiving parts 52 are respectively provided at the lower end portions of the sidewalls 34 of the supply roller support part 39. The receiving parts 52 are provided below the rear end portions of the first support part side welding surfaces 43 and lower end surfaces thereof are extended in a flat shape along the front-rear direction.

Additionally, the right receiving part 52 has a substantially rectangular shape which is long in the front-rear direction, when seen from a bottom, and has a right-angled triangle having a right angle at a rear-lower end portion, when seen from a side. In addition, the right receiving part 52 has three jig fitting holes 54 (an example of a regulating part).

Each of the jig fitting holes 54 is notched into a substantially rectangular shape from a lower end surface thereof toward the upper side, when seen from a bottom, and is provided in parallel with each other at an interval in the front-rear direction.

In addition, the left receiving part 52 has a substantially square shape when seen from a bottom, and has a jig contact surface 55 extending in the upper-lower direction at a front end edge (an example of a regulating part).

(1-2) Second Frame (1-2-1) Structure of Second Frame

As shown in FIGS. 4 and 5, the second frame 33 configures the upper side of the frame 31 and has a substantially rectangular flat plate shape, when seen from a plan view.

The second frame 33 integrally includes a toner accommodating part covering part 61 that covers the toner accommodating part of the first frame 31 from its upper side and a supply roller covering part 62 that covers the supply roller 23 from its upper side.

The toner accommodating part covering part 61 has a substantially rectangular flat plate shape, when seen from a plan view, which has a size capable of completely covering the toner accommodating part 38 of the first frame 32. The toner accommodating part covering part 61 has a swelling part 63 and a first contact part 64.

The swelling part 63 is upwardly protruded at a center portion of the toner accommodating part covering part 61.

The first contact part 64 is provided at both sides and a back side of the swelling part 63 and extends in the front-rear direction and the left-right direction so as to surround the swelling part 63. The first contact part 64 has a substantially V-shaped flat plate shape that is opened toward the rear side, when seen from a plan view, so as to correspond to the first accommodating part side welding surface 42 of the first frame 32.

When the second frame 33 is connected to the first frame 31, the first contact part 63 is contacted to the first accommodating part side welding surface 42 of the first frame 32. In addition, the first contact part 64 is formed with a pair of positioning holes 65.

Both positioning holes 65 are respectively provided at left and right rear end portions of the first contact part 64 to penetrate therethrough and have a substantially circular shape capable of receiving the frame positioning bosses 53 of the first frame 32, when seen from a plan view.

The supply roller covering part 62 has a substantially rectangular flat plate shape extending from a rear end portion of the toner accommodating part covering part 61 toward the rear, when seen from a plan view. In addition, the supply roller covering part 62 has a pair of second contact parts 66, a reinforcement part 67 and a seal adhesion part 68.

The second contact parts 66 are respectively provided at an interval at the left-right end portions of the supply roller covering part 62. In addition, the second contact parts 66 are continued from the rear end portions of the first contact part 64 and have a flat plate shape that is downwardly inclined toward the rear so as to correspond to the first support part side welding surfaces 43 of the first frame 32, respectively.

The reinforcement part 67 is extended rearward from the back side lower end portion of the toner accommodating part covering part 61 between the second contact parts 66. The reinforcement part 67 has a horizontal rib 69 and a vertical rib 70.

The horizontal rib 69 has a flat plate shape extending in the front-rear direction and in the left-right direction at a substantially center of the reinforcement part 67 in the upper-lower direction. In addition, the horizontal rib 69 is extended to intersect the substantially center of the second contact parts 66 in the front-rear direction, as viewed from the left-right direction (refer to FIG. 3).

The vertical rib 70 is extended in the upper-lower direction to be orthogonal to the horizontal rib 69 and has a first rib 71 and a plurality of second ribs 72.

The first rib 71 has a rod shape extending in the left-right direction at a substantially center of the reinforcement part 67 in the front-rear direction and is provided over the entire reinforcement part 67 in the left-right direction.

Each of the second ribs 72 has a rod shape extending in the front-rear direction and is provided at an interval in parallel with each other in the left-right direction. In addition, each of the second ribs 72 is provided over the entire reinforcement part 67 in the left-right direction.

The seal adhesion part 68 has a flat plate shape extending in the upper-lower direction and the left-right direction at the rear end portion of the reinforcement part 67. The seal adhesion part 68 is connected to the horizontal rib 69 at a substantially center of the seal adhesion part in the upper-lower direction and is connected to the second contact parts 66 at lower end portions of both left and right end portions thereof. In other words, the seal adhesion part 68 is extended upwardly from the rear end portions of the second contact parts 66.

(1-2-2) Structure Related to Welding in Second Frame

The second frame 33 has a second welding surface 81.

The second welding surface 81 includes lower surfaces of the first contact part 64 and the second contact parts 66 and is formed to correspond to the first welding surface 41. In addition, the second welding surface 81 has a second accommodating part side welding surface 82 (an example of an accommodating part side welding surface) and second support part side welding surfaces 83 (an example of a support part side welding surface).

The second accommodating part side welding surface 82 includes the lower surface of the first contact part 64 and is defined into a substantially U-shape having an opened back side when seen from a bottom, correspondingly to the first accommodating part side welding surface 42.

The second support part side welding surfaces 83 include the lower surfaces of the second contact parts 66 and are extended downwardly toward the rear, correspondingly to the first support part side welding surfaces 43.

The second frame 33 has a welding rib 84. The welding rib 84 is provided to surround the swelling part 63 and the reinforcement part 67 over both the second accommodating part side welding surface 82 and the second support part side welding surfaces 83. The welding rib 84 has a accommodating part side welding rib 85 provided on the lower surface of the second accommodating part side welding surface 82 and support part side welding ribs 86 provided on the lower surfaces of the second support part side welding surfaces 83.

The accommodating part side welding rib 85 is extended in the left-right direction at the front end portion of the second accommodating part side welding surface 82 and is bent rearward and then extended rearward at the both end portions of the left-right direction of the second frame 33.

The support part side welding rib 86 is continued from a rear end portion of the accommodating part side welding rib 85 and is extended in the front-rear direction along an outward end portion of the second support part side welding surface 83 in the left-right direction.

(3) Layer Thickness Regulating Blade

The developing cartridge 16 includes the layer thickness regulating blade 24, as shown in FIGS. 2 and 3.

The layer thickness regulating blade 24 includes a blade member 91 that contacts the developing roller 22, a support member 92 that supports the blade member 91 and a reinforcement member 93 that reinforces the blade member 91.

The blade member 91 is formed of a thin metal plate having elasticity, and has a substantially rectangular flat plate shape extending in the left-right direction, when seen from a front face. In addition, penetrated holes 94 that penetrate the blade member 91 in a thickness direction (front-rear direction) thereof are formed at both end portions of an upper end portion of the blade member 91 in the left-right direction.

The support member 92 is formed of a metal plate thicker than the blade member 91 and has a substantial L-shape when seen from a side sectional view. Specifically, the support member 92 has a horizontal part that extends in the front-rear direction and a vertical part that extends downwardly from a rear end portion of the horizontal part. The horizontal part of the support member 92 is formed with support member side screw holes 97 (refer to FIG. 3). In addition, the support member 92 includes protrusions 95 and attachment parts 96 at the vertical part.

The four support member side screw holes 97 are formed at an interval in the left-right direction so as to penetrate the horizontal part of the support member 92 in a thickness direction (upper-lower direction) thereof.

The protrusions 95 have a substantially cylindrical shape protruding from a rear end surface of the support member 92 to the rear at both end portions of the left-right direction of the convex part.

The attachment parts 96 respectively have a substantially rectangular flat plate shape protruding upwardly from a rear side upper end edge of the support member 92 at both end portions of the attachment part in the left-right direction, when seen from a front face. In addition, each of the attachment parts 96 is formed with a hole (not shown) that penetrates the attachment part 96 in a thickness direction (front-rear direction) thereof.

Similarly to the support member 92, the reinforcement member 93 is formed with a metal plate thicker than the blade member 91, and has a substantially L-shape when seen from a side sectional view. The reinforcement member has a horizontal part that extends in the front-rear direction and a vertical part that extends downwardly from a rear end portion of the horizontal part. The horizontal part of the reinforcement member 93 is formed with reinforcement member side screw holes 99 (refer to FIG. 3).

The four reinforcement member side screw holes 99 are provided to correspond to the support member side screw holes 97 and are formed at an interval in the left-right direction so as to penetrate the horizontal part of the reinforcement member 93 in a thickness direction (upper-lower direction) thereof.

The blade member 91 is attached to the rear face side of the vertical part of the support member 92 so that the protrusions 95 of the support member 92 are inserted into the penetrated holes 94 of the blade member 91 from the front.

In addition, the reinforcement member 93 is connected with the support member 92 so that the reinforcement member is covered to the support member 92 from the upper side. Specifically, the support member 92 and the reinforcement member 93 are connected such that the horizontal parts thereof are opposed to each other in the upper-lower direction and the vertical parts thereof are opposed to each other in the front-rear direction. Thereby, the upper end portion of the blade member 91 is interposed between the vertical part of the support member 92 and the vertical part of the reinforcement member 93.

In addition, screws 100 are engaged with the support member side screw holes 97 and the reinforcement member side screw holes 99. Thereby, the support member 92 and the reinforcement member 93 are fixed while the blade member 91 being interposed therebetween, thereby configuring the layer thickness regulating blade 24.

The layer thickness regulating blade 24 is attached to the blade fixing parts 46 of the first frame 32 at the attachment parts 96 of the support member 92. Specifically, the blade positioning boss 48 of the blade fixing part 46 is inserted into an attachment hole (not shown) of the attachment part 96 from the front, so that the screw 101 is engaged with the blade positioning boss 48. Thereby, the layer thickness regulating blade 24 is fixed to the blade fixing parts of the first frame 32.

(3) Other Structures

The developing cartridge 16 includes a driving unit 111 at the left side of the frame 31, to which driving force from a driving source (not shown) of the body casing 2 is inputted, and an electrode unit 112 at the right side of the frame 31, to which power from a power supply (not shown) of the body casing 2 is inputted, as shown in FIGS. 2 and 3.

The driving unit 111 transmits the driving force inputted from the driving source (not shown) to the developing roller 22 and the supply roller 23 by a gear transmission mechanism (not shown).

The electrode unit 112 transmits the inputted power to the developing roller 22 and the supply roller 23 by a wiring cable (not shown).

In addition, the developing cartridge 16 has toner receiving members 114 at outer sides of the left-right direction the developing roller support part 36.

The toner receiving member 114 integrally includes a cover part 115 that covers both end portions of the left-right direction of the developing roller 22 at the lower sides and collar parts 116 that rotatably support both end portions of the developing roller axis 50 in the left-right direction.

The cover part 115 is opened at its upper and front sides and has a substantially conical shape extending in the left-right direction. The cover part 115 receives toner that falls down from both end portions of the left-right direction of the developing roller 22.

The collar part 116 is provided above an outer end portion of the cover part 115 in the left-right direction, is extended in the left-right direction and has a substantially cylindrical shape having an inner diameter capable of receiving the developing roller axis 50.

Figure 8:
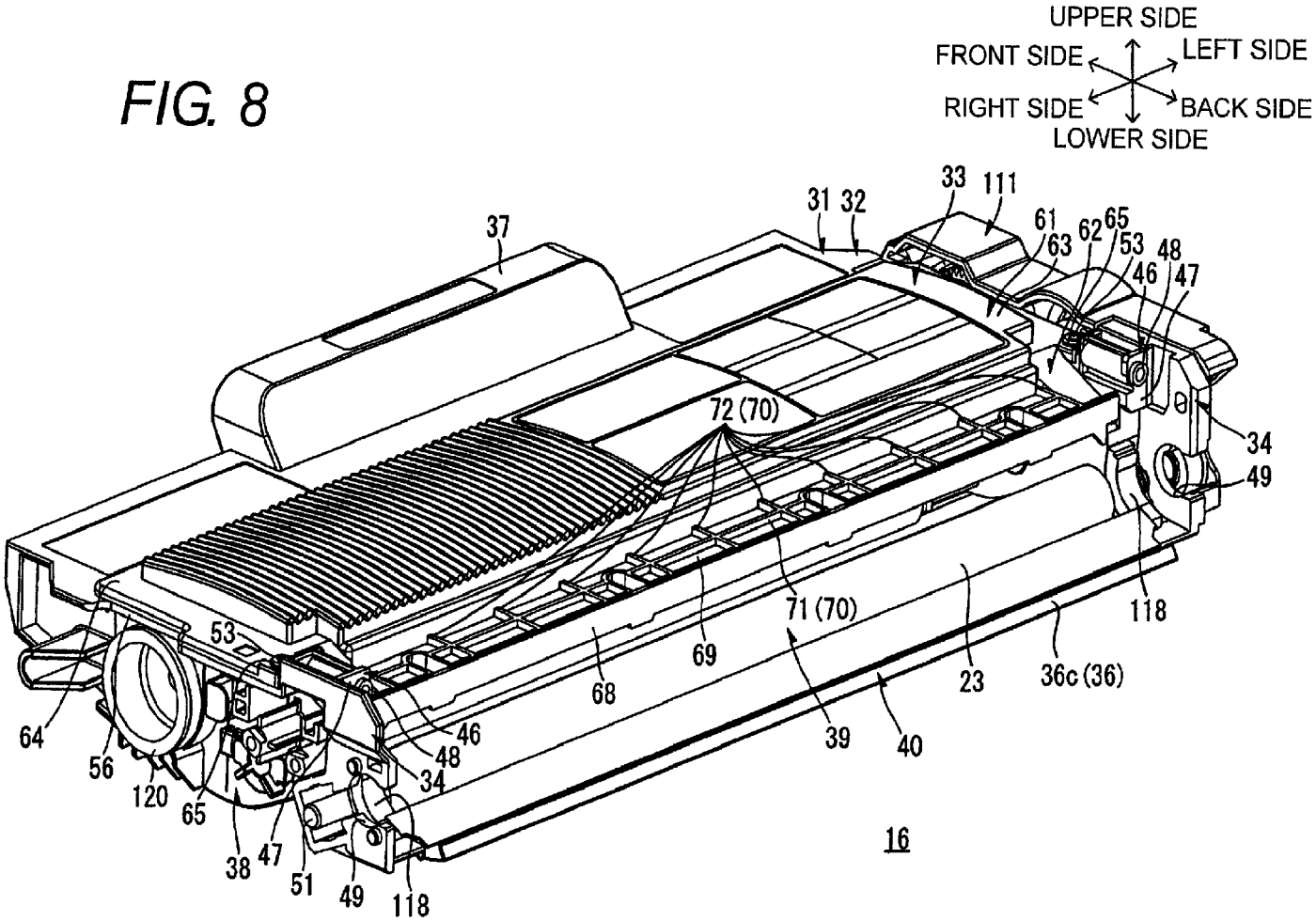
FIG. 8 is a perspective view of a state where a supply roller is provided to a frame, as seen from a right-upper side.

In addition, the developing cartridge 16 has a seal member 117 (refer to FIG. 9) and a pair of side seals 118 (refer to FIG. 8).

The seal member 117 is formed of sponge made of resin and the like and has a substantially rectangular column shape extending in the left-right direction. A length of the left-right direction of the seal member 117 is substantially same as that of the seal adhesion part 68 of the second frame 33. The seal member 117 is adhered on the rear end surface of the seal adhesion part 68 of the second frame 33 and seals a space between the seal adhesion part 68 and the layer thickness regulating blade 24. The rear end surface of the seal adhesion part 68 is defined as a seal surface.

The side seals 118 are formed of sponge made of resin and the like, have a substantially rectangular column shape extending in the upper-lower direction and are adhered to the lower end portions of the step portions 45 of the first frame 32.

The developing cartridge 16 has a cap 120 for sealing the toner filling opening 119. The cap 120 is formed of an elastic material such as resin and the like and has a substantially cylindrical shape having a left closed end portion and an outer diameter that is slightly larger than an inner diameter of the toner filling opening 119. The cap 120 is pushed to the toner filling opening 119 from the right side.

3. Assembling of Developing Cartridge (1) Assembling of Frames

When assembling the developing cartridge 16, the frame 31 is first assembled.

When assembling the frame 31, the second frame 33 is overlapped and welded with the upper end surface of the first frame 32, like a cover closing from the upper side.

Specifically, the first frame 32 and the second frame 33 are first prepared.

Then, the second frame 33 is connected with the first frame 32.

For connecting the second frame 33 with the first frame 32, the second frame 33 is positioned above the first frame 32 so that the frame positioning bosses 53 of the first frame 32 are inserted into the positioning holes 65 of the second frame 33, and the reinforcement part 67 of the second frame 33 is arranged between the blade fixing parts 46 of the first frame 32, and then the second frame 33 is overlapped and fitted above the first frame 32.

Thus, the frame positioning bosses 53 of the first frame 32 are inserted into the positioning holes 65 of the second frame 33 from the lower side and the reinforcement part 67 of the second frame 33 is arranged between the blade fixing parts 46 of the first frame 32.

In addition, the second accommodating part side welding surface 82 of the second frame 33 is contacted to the first accommodating part side welding surface 42 of the first frame 32 and the second support part side welding surfaces 83 of the second frame 33 are contacted to the first support part side welding surfaces 43 of the first frame 32.

Then, the connected first frame 32 and second frame 33 are welded each other.

For welding the first frame 32 and the second frame 33, the second accommodating part side welding surface 82 of the second frame 33 and the first accommodating part side welding surface 42 of the first frame 32 are welded, and the second support part side welding surfaces 83 of the second frame 33 and the first support part side welding surfaces 43 of the first frame 32 are also welded.

Specifically, for welding the second accommodating part side welding surface 82 of the second frame 33 and the first accommodating part side welding surface 42 of the first frame 32, the flange parts 56 of the first frame 32 and the first contact parts 64 of the second frame 33 are ultrasonic-welded while pressing them from both sides.

Thus, the welding rib 84 provided on the second accommodating part side welding surface 82 of the second frame 33 is melted, so that the second accommodating part side welding surface 82 of the second frame 33 and the first accommodating part side welding surface 42 of the first frame 32 are welded.

Figure 7A:
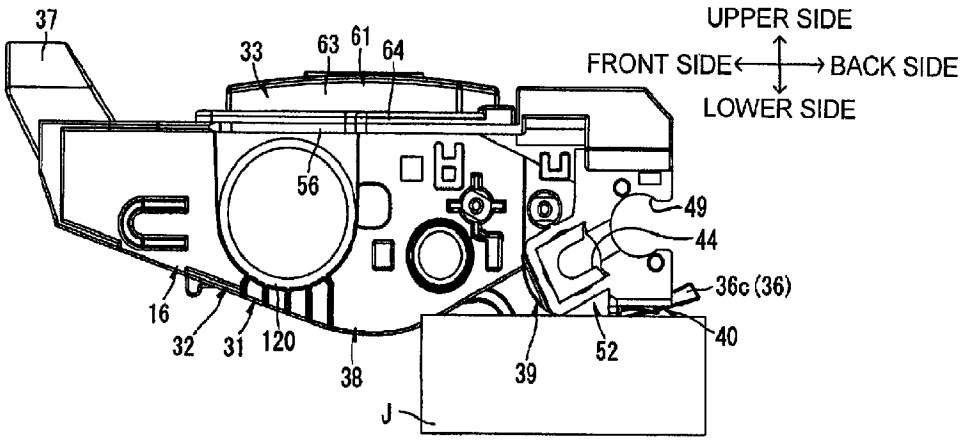
FIG. 7A is a side view showing a state where a first frame and a second frame are connected and a receiving part is placed on a jig.

At this time, the support part side welding surfaces 43 of the first frame 32 and the second support part side welding surfaces 83 of the second frame 33 are also welded. However, in this case, as shown in FIG. 7A, the connected first frame 32 and second frame 33 are first put on a jig J at the receiving parts 52.

Figure 7B:
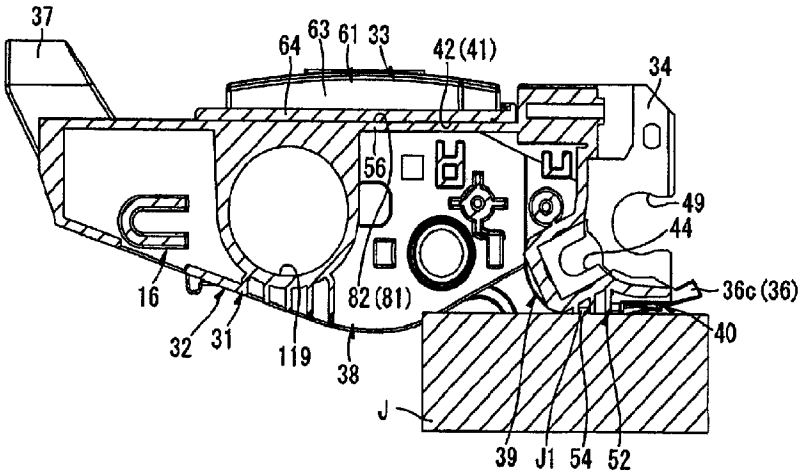
FIG. 7B is a side sectional view of FIG. 7A.

At this time, as shown in FIG. 7B, when welding the first support part side welding surface 43 and the second support part side welding surface 83 of the right side, the overlapped first frame 32 and second frame 33 are put on the jig J so that a protrusion J1 formed on a surface of the jig J is fitted into the jig fitting hole 54 of the right receiving part 52.

In addition, although not shown, when welding the first support part side welding surface 43 and the second support part side welding surface 83 of the left side, the overlapped first frame 32 and second frame 33 are put on the jig J so that the protrusion J1 is contacted to the jig contact surface 55 of the left receiving part 52 from the front.

Then, the ultrasonic welding is performed while pressing the second contact parts 66 of the second frame 33 from the upper side.

At this time, the receiving parts 52 are applied with the force of pressing the second contact parts 66 of the second frame 33 from the upper side.

In addition, since the protrusion J1 is fitted into the jig fitting hole 54 (or the protrusion J1 is contacted to the jig contact surface 55), the first frame 32 and the second frame 33 are regulated from moving in the front direction.

When the ultrasonic is applied, the welding rib 84 provided on the second support part side welding surfaces 83 of the second frame 33 is melted due to the heat, so that the second support part side welding surfaces 83 of the second frame 33 and the first support part side welding surfaces 43 of the second frame 32 are welded.

Accordingly, the first frame 32 and the second frame 33 are completely welded, so that the assembling of the frame 31 is completed.

(2) Assembling of Other Members to Frame

Then, as shown in FIG. 8, the supply roller 23 is assembled to the frame 31.

The supply roller 23 is assembled to the supply roller support part 39 so that both end portions of the left-right direction of the supply roller axis 51 are rotatably supported to the supply roller support recesses 44.

Then, the side seals 118 and the driving unit 111 are assembled to predetermined positions of the frame 31.

Figure 9:
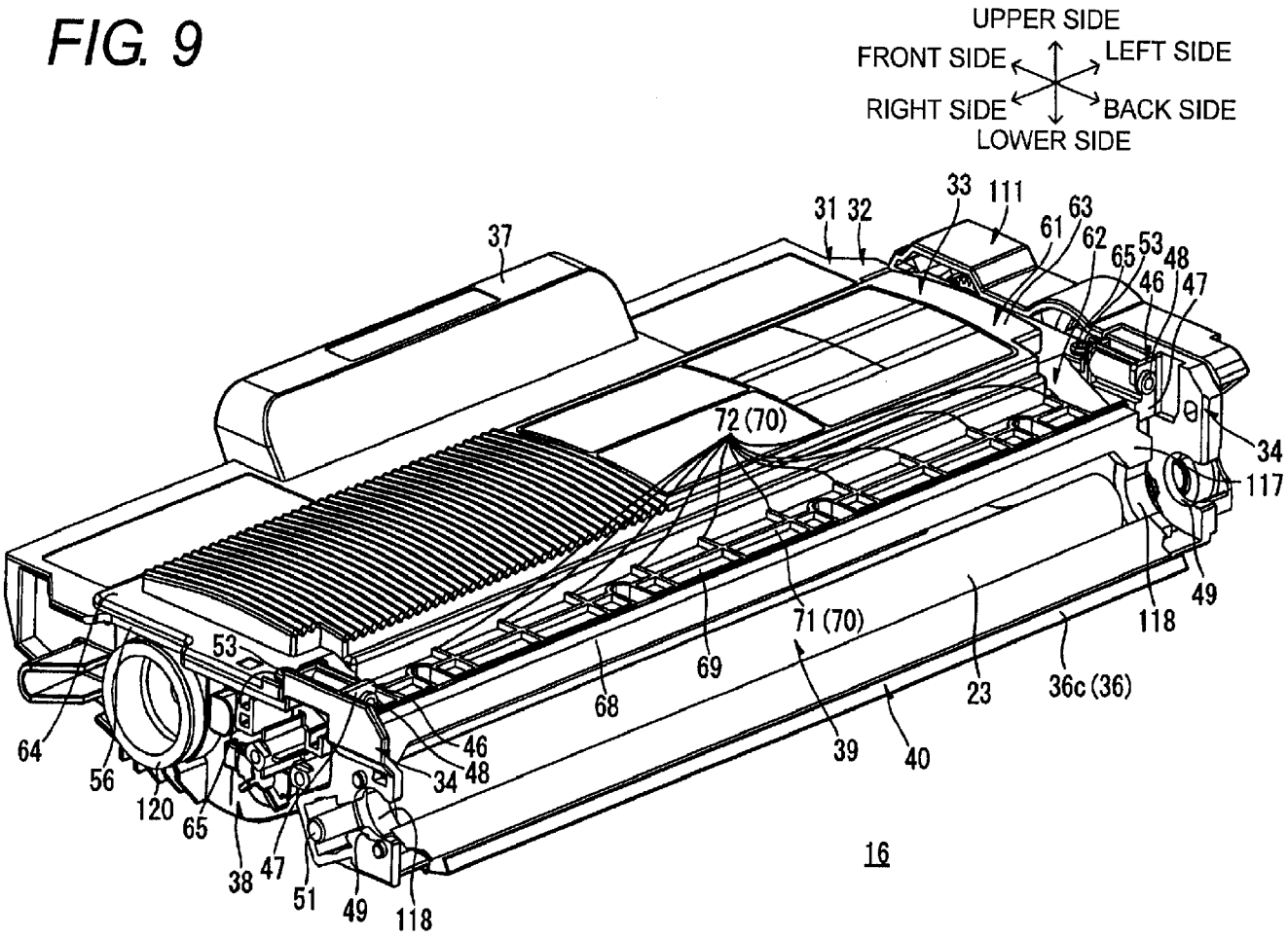
FIG. 9 is a perspective view of a state where the supply roller and a seal member are provided to the frame, as seen from a right-upper side.

Then, as shown in FIG. 9, the seal member 117 is adhered to the rear side end surface of the seal adhesion part 68. After that, as shown in FIG. 2, the layer thickness regulating blade 24 is assembled to the frame 31.

For assembling the layer thickness regulating blade 24 to the frame 31, the layer thickness regulating blade 24 is positioned with respect to the frame 31 so that the blade positioning boss 48 of the first frame 32 is fitted into an attachment hole (not shown) of the layer thickness regulating blade 24, and then the layer thickness regulating blade 24 is assembled to the frame 31 from the rear.

As a result, the blade positioning boss 48 of the first frame 32 is fitted into the attachment hole (not shown) of the layer thickness regulating blade 24 and the layer thickness regulating blade 24 is thus assembled to the frame 31.

Then, when the screw 101 is engaged to the blade positioning boss 48, the layer thickness regulating blade 24 is fixed to the frame 31.

At this time, the seal member 117 is compressed from the back side toward the front side by the vertical part of the support member 92. Thereby, the seal member 117 seals a space between the vertical part of the support member 92 and the seal adhesion part 68 of the second frame 33.

In addition, at this time, the horizontal parts of the support member 92 and the reinforcement member 93 cover the reinforcement part 67 and the second contact parts 66 of the second frame 33 from the upper side. In other words, the layer thickness regulating blade 24 covers the first support part side welding surfaces 43 and the second support part side welding surfaces 83 from the upper side.

Then, both end portions of the developing roller axis 50 in the left-right direction are inserted into the developing roller support recesses 49 from the inner sides of the left-right direction, respectively, so that the developing roller 22 is arranged at the developing roller support part 40.

As a result, the peripheral surface of the developing roller 22 is contacted to the lower end portion of the blade member 91 from the rear side. In addition, both end portions of the left-right direction of the developing roller 22 are contacted to the side seals 118 from the rear side. In the meantime, at this time, both end portions of the left-right direction of the developing roller 22 are further protruded outward than both sidewalls 34 of the frame 31.

Then, the toner receiving members 114 are respectively assembled to the front end portions of the frame 31 from both sides in the left-right direction so that the collar parts 116 are fitted to the outer sides of both end portions of the developing roller axis 50 in the left-right direction.

As a result, both end portions of the developing roller axis 50 in the left-right direction are rotatably supported by the collar parts 116.

Thereby, the developing roller 22 is press-contacted to the blade member 91 of the layer thickness regulating blade 24. In addition, the developing roller 22 is press-contacted to the side seals 118, so that both end portions of the left-right direction of the developing roller 22 and the frame 31 are sealed therebetween.

Then, when the electrode unit 112 is assembled to the right end portion of the frame 31, the assembling of the developing cartridge 16 is completed.

Then, toner is filled into the toner accommodating part 38 through the toner filling opening 119 and the cap 120 is then pushed into the toner filling opening 112 to enclose the toner in the toner accommodating part 38.

4. Operational Effects (1) According to the above-described developing cartridge, as shown in FIG. 4, the first support part side welding surfaces 43 and the second support part side welding surfaces 83 are inclined downwardly from the front toward the rear. The layer thickness regulating blade 24 is provided to cover the first support part side welding surfaces 43 and the second support part side welding surfaces 83 from the upper side.

Therefore, it is possible to provide the layer thickness regulating blade 24 at the lower side with being retreated, depending on the inclination of the first support part side welding surfaces 43 and the second support part side welding surfaces 83.

As a result, the developing cartridge 16 can be made small (flat shape) in the upper-lower direction by the retreated dimension of the layer thickness regulating blade 24.

In addition, according to the above-described developing cartridge 16, the first frame 32 and the second frame 33 have the first support part side welding surfaces 43 and the second support part side welding surfaces 83 formed correspondingly to the supply roller support part 39. The first support part side welding surfaces 43 and the second support part side welding surfaces 83 are continued from the first accommodating part side welding surface 42 and the second accommodating part side welding surface 82 formed correspondingly to the toner accommodating part 38.

Therefore, it is possible to seal a space between the first frame 32 and the second frame 33 by the welding of the first support part side welding surfaces 43 and the second support part side welding surfaces 83, without separately providing a seal member of sealing a space between the first frame 32 and the second frame 33 at the supply roller support part 39.

As a result, it is possible to reduce the number of parts and to further prevent toner from being leaked.

(2) In addition, according to the above-described developing cartridge 16, as shown in FIG. 2, it is possible to fix the layer thickness regulating blade 24 to the first frame 32 at the left and right blade fixing parts 46, at the outer sides of the first support part side welding surfaces 43 and the second support part side welding surfaces 83.

Therefore, even when the inclinations of the first support part side welding surfaces 43 and the second support part side welding surfaces 83 have a tolerance in the left-right direction, it is possible to fix the layer thickness regulating blade 24, without making the layer thickness regulating blade follow the first support part side welding surfaces 43 and the second support part side welding surfaces 83.

As a result, it is possible to prevent the layer thickness regulating blade 24 from being bent.

(3) In addition, according to the above-described developing cartridge 16, as shown in FIG. 9, the seal surface (rear end portion surface of the seal adhesion part 68) for providing the seal member 117, which seals a space between the rear end portion of the second frame 33 and the layer thickness regulating blade 24, is provided to the second frame 33.

Therefore, it is possible to reduce the number of parts, without separately providing a member for providing the seal member 117.

(4) In addition, in the developing cartridge disclosed in JP-A-2009-168993, the blade assembly having a layer thickness regulating blade is fixed on surfaces of left-side and right-side wall parts of a lower frame so as to cover the beam part from the upper side.

When the developing cartridge is mounted to a printer and an image forming operation is performed, the laser beam passes between the blade assembly and the drum frame and is irradiated on the photosensitive drum.

In the meantime, for reducing the size of such printer, it is attempted to reduce an interval between the blade assembly and the drum frame. However, when an interval between the blade assembly and the drum frame is reduced, the laser beam is apt to interfere with the blade assembly.

However, according to the above-described developing cartridge 16, as shown in FIG. 2, it is possible to provide the layer thickness regulating blade 24 at the lower side with being retreated.

Therefore, while the developing cartridge 16 can be made small (flat type) in the upper-lower direction, it is possible to prevent the laser beam from interfering with the layer thickness regulating blade 24.

(5) According to the above-described developing cartridge 16, as shown in FIGS. 4 and 5, the first frame 32 has the first accommodating part side welding surface 42 formed correspondingly to the toner accommodating part 38 and the first support part side welding surfaces 43 formed correspondingly to the roller support part (supply roller support part 39 and developing roller support part 40).

In addition, the second frame 33 also has the second accommodating part side welding surface 82 formed correspondingly to the toner accommodating part 38 and the second support part side welding surfaces 83 formed correspondingly to the roller support part (supply roller support part 39 and developing roller support part 40).

Therefore, it is possible to seal a space between the first frame 32 and the second frame 33 by the welding of the first support part side welding surfaces 43 and the second support part side welding surfaces 83 without separately providing the roller support part with a member for sealing a space between the first frame 32 and the second frame 33.

As a result, it is possible to reduce the number of parts and to further prevent developer from being leaked.

In addition, in the first frame 32, the first accommodating part side welding surface 42 extends in the direction (front-rear direction and left-right direction) orthogonal to an overlapping direction (upper-lower direction) of the first frame 32 and the second frame 33, and the first support part side welding surfaces 43 are continued from the first accommodating part side welding surface 42 and are inclined downwardly toward the rear from the front.

Similarly, also in the second frame 33, the second accommodating part side welding surface 82 extends in the front-rear direction and left-right direction and the second support part side welding surfaces 83 are continued from the second accommodating part side welding surface 82 and are inclined downwardly toward the rear from the front.

Therefore, it is possible to downwardly retreat the rear end portion of the second frame 33, depending on the inclinations of the first support part side welding surfaces 43 and the second support part side welding surfaces 83.

As a result, the developing cartridge 16 can be made small (flat shape) in the upper-lower direction by the retreated dimension of the second frame 33.

However, when the first support part side welding surfaces 43 and the second support part side welding surfaces 83 are inclined, an inclined intersection may occur on the first support part side welding surfaces 43 or second support part side welding surfaces 83. Thus, in some cases, when the first frame 32 and the second frame 33 are overlapped, it may be difficult to closely contact the first support part side welding surfaces 43 of the first frame 32 and the second support part side welding surfaces 83 of the second frame 33 because of the inclined intersection.

Herein, according to the above-described developing cartridge 16, the first support part side welding surfaces 43 and the second support part side welding surfaces 83 are wider than the welding area where the first frame 32 and the second frame 33 are welded. Thereby, compared to a case where the first frame 32 and the second frame 33 are welded over the entire widths thereof, it is possible to secure flexibility of the first support part side welding surfaces 43 and the second support part side welding surfaces 83 even after the first frame 32 and the second frame 33 are welded.

In addition, according to the above-described developing cartridge 16, the reinforcement part 67 is provided between the second support part side welding surfaces 83.

Therefore, it is possible to secure rigidity of the first frame 32 or second frame 33 at the reinforcement part 67 after the first frame 32 and the second frame 33 are welded.

(6) Additionally, according to the above-described developing cartridge 16, as shown in FIG. 8, the reinforcement part 67 has the first rib 71 extending in the left-right direction.

Therefore, it is possible to secure the rigidity of the first frame 32 or second frame 33 in the left-right direction.

(7) Further, according to the above-described developing cartridge 16, as shown in FIG. 8, the reinforcement part 67 has the second ribs 72 extending in the direction orthogonal to the left-right direction.

Therefore, it is possible to secure the rigidity of the first frame 32 or second frame 33 in the direction orthogonal to the left-right direction.

(8) In addition, according to the above-described developing cartridge 16, as shown in FIG. 8, the first rib 71 and the second ribs 72 are provided over the reinforcement part 67 in the left-right direction.

Therefore, it is possible to secure the rigidity of the first frame 32 or second frame 33 over the left-right direction.

(9) Additionally, according to the above-described developing cartridge 16, as shown in FIG. 3, the reinforcement part 67 intersects with the center of the second support part side welding surfaces 83 extending to the rear from the front, as viewed form the left-right direction.

Therefore, the flexibility of the front end portions or rear end portions of the second support part side welding surfaces 83 is secured without being reinforced by the reinforcement part 67.

As a result, it is possible to secure the rigidity of the first frame 32 or second frame 33 without deteriorating the flexibility of the front or rear end portions of the second support part-side welding surfaces 83.

(10) According to the above-described developing cartridge 16, as shown in FIGS. 4 and 5, the first frame 32 and the second frame 33 have the first welding surface 41 and the second welding surface 81 that are formed to surround the toner accommodating part 38 and the carrier support part (supply roller support part 39 and developing roller support part 40).

Therefore, it is possible to seal a space between the first frame 32 and the second frame 33 by the welding of the first welding surface 41 and the second welding surface 81, without separately providing the carrier support part with a member for sealing a space between the first frame 32 and the second frame 33.

As a result, it is possible to reduce the number of parts and to further prevent developer from being leaked.

(11) In the meantime, the driving unit 111 that transfers the driving force originating from the outside to the developing roller 22, the electrode unit 112 that transfers the power originating from the outside to the developing roller 22 and the like are provided to the outer sides of the left-right direction of the carrier support part.

Therefore, when welding the first frame 32 and the second frame 33 at the carrier support part, in some cases, it may be difficult to weld the first frame 32 and the second frame 33 with the jig J at both end portions of the left-right direction of the carrier support part.

Hence, according to the above-described developing cartridge 16, as shown in FIG. 5, the first frame 32 has the receiving parts 52 at the carrier support part (i.e., the lower end portion of the carrier support part) opposite to the upper side having the first welding surface 41 formed thereon.

Therefore, when the first frame 32 and the second frame 33 are welded with the receiving parts 52 being placed on the jig J, it is possible to receive the force of pressing the second frame 32 toward the first frame 32 by the receiving parts 52 placed on the jig J.

As a result, it is possible to securely weld the first frame 32 and the second frame 33 at the carrier support part.

(12) In addition, according to the above-described developing cartridge 16, as shown in FIGS. 7A and 7B, when welding the first frame 32 to the second frame 33, it is possible to regulate the movement of the first frame 32 in the front-rear direction by the jig fitting holes 54 or jig contact surface 55.

Therefore, when welding the first support part side welding surfaces 43 and the second support part side welding surfaces 83, which are inclined, it is possible to prevent the first frame 32 from being dislocated in the front-rear direction even when the second frame 33 is pushed toward the first frame 32.

As a result, it is possible to weld the first frame 32 and the second frame 33 more certainly.

(13) Additionally, according to the method for manufacturing the developing cartridge 16, as shown in FIGS. 7A and 7B, the connected first frame 32 and second frame 33 are welded with the receiving parts 52 being placed on the jig J while the second frame 33 is pressed toward the first frame 32.

Therefore, it is possible to receive the force of pressing the second frame 33 toward the first frame 32 by the receiving parts 52 placed on the jig J. As a result, it is possible to securely weld the first frame 32 and the second frame 33.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developing cartridge comprising:

a developing roller having a shaft extending in a first direction;

a developing roller layer thickness regulating member including:

a blade member extending in the first direction and a second direction that is orthogonal to the first direction, a first end portion of the blade member in the second direction being in contact with a surface of the developing roller; and a support member supporting the blade member, the support member including a first support portion extending in the second direction and supporting a second end portion of the blade member in the second direction, and a second support portion extending in a third direction that is orthogonal to the first direction and the second direction;

a first frame including:

a developer accommodating part;

a pair of first welding surfaces on the first frame; and a pair of second welding surfaces on the first frame, one of the pair of second welding surfaces extending from one of the pair of first welding surfaces and inclined downwardly with respect to the one of the pair of first welding surfaces in the third direction, the one of the pair of second welding surfaces being positioned between the first support portion and the one of the pair of first welding surfaces in the third direction, other of the pair of second welding surfaces extending from other of the pair of first welding surfaces and inclined downwardly with respect to the other of the pair of first welding surfaces in the third direction, the other of the pair of second welding surfaces being positioned between the first support portion and the other of the pair of first welding surfaces in the third direction, and each of the pair of second welding surfaces extending toward the surface of the developing roller; and a second frame covering the developer accommodating part as a lid, the second frame including:

a pair of third welding surfaces of the second frame, one of the pair of third welding surfaces being welded with one of the pair of first welding surfaces, and the other of the pair of third welding surfaces being welded with the other of the pair of first welding surface; and a pair of fourth welding surfaces of the second frame, one of the pair of fourth welding surfaces being welded with the one of the pair of second welding surfaces, and the one of the pair of fourth welding surfaces inclined downwardly with respect to the one of the pair of third welding surfaces in the third direction, the other of the pair of fourth welding surfaces being welded with the other of the second welding surfaces, and the other of the pair of fourth welding surfaces inclined downwardly with respect to the other of the pair of third welding surfaces in the third direction, the one of the pair of fourth welding surfaces being positioned between the first support portion and the one of the pair of third welding surfaces in the third direction, the other of the pair of fourth welding surfaces being positioned between the first support portion and the other of the pair of third welding surfaces in the third direction, each of the pair of fourth welding surfaces extending toward the surface of the developing roller, wherein the second supporting portion extends from the first supporting portion toward the pair of fourth welding surfaces, and wherein the second support member of the developing roller layer thickness regulating member covers at least a portion of the one of the pair of fourth welding surfaces and at least a portion of the other of the pair of fourth welding surfaces.

2. The developing cartridge according to claim 1, wherein the support member of the developing roller layer thickness regulating member further comprises:

a first part contacting the blade and a second part extending orthogonal to the first part.

3. The developing cartridge according to claim 1, wherein the second welding surface and the fourth welding surface are welded together where a width of the weld is less than widths of each of the second welding surface and the fourth welding surface.

4. The developing cartridge according to claim 1, wherein at least one of the second welding surface and the fourth welding surface includes a welding rib, and wherein the welding rib occupies less than all of the surface of the one of the second welding surface and the fourth welding surface.

5. The developing cartridge according to claim 1, wherein the second welding surface extends continuously from the first welding surface.

6. A developing cartridge comprising:

a developing roller having a shaft extending in a first direction;

a developing roller layer thickness regulating member including:

a blade member extending in the first direction and a second direction that is orthogonal to the first direction, a first end portion of the blade member in the second direction being in contact with a surface of the developing roller; and a support member supporting the blade member, the support member including a first support portion extending in the second direction and supporting a second end portion of the blade member in the second direction, and a second support portion extending in a third direction that is orthogonal to the first direction and the second direction;

a first frame including:

a developer accommodating part;

a pair of first welding surfaces of the first frame; and a pair of second welding surfaces of the first frame, the pair of second welding surfaces spaced from each other, one of the second welding surfaces extending from one of the pair of first welding surfaces and inclined downwardly with respect to one of the pair of first welding surfaces the third direction, the one of the pair of second welding surfaces being positioned between the first support portion and the one of the pair of first welding surfaces in the third direction, other of the pair of second welding surfaces extending from other of the pair of first welding surfaces and inclined downwardly with respect to the other of the pair of first welding surfaces in the third direction, the other of the pair of second welding surfaces being positioned between the first support portion and the other of the pair of first welding surfaces in the third direction, and each of the pair of second welding surfaces extending toward the surface of the developing roller; and a second frame covering the developer accommodating part as a lid, the second frame including:

a pair of third welding surfaces of the second frame, one of the air of third welding surfaces being welded with one of the first welding surfaces and the other of the pair of third welding surfaces being welded with the other of the pair of first welding surfaces; and a pair of fourth welding surfaces of the second frame, one of the air of fourth welding surfaces being welded with one of the pair of second welding surfaces and inclined downwardly with respect to one of the pair of third welding surfaces in the third direction, the other of the pair of fourth welding surfaces being welded with the other of the second welding surfaces, and the other of the pair of fourth welding surfaces inclined downwardly with respect to the other of the pair of third welding surfaces in the third direction, the one of the pair of fourth welding surfaces being positioned between the first support portion and the one of the pair of third welding surfaces in the third direction, the other of the pair of fourth welding surfaces being positioned between the first support portion and the other of the pair of third welding surfaces in the third direction, each of the pair of fourth welding surfaces extending toward the surface of the developing roller, wherein the second supporting portion extends from the first supporting portion toward the pair of fourth welding surfaces, and wherein the second support member of the developing roller layer thickness regulating member extends parallel to the developing roller and a portion of the second support member is located above the one of the pair of the fourth welding surfaces and another portion of the second support member is located above the other of the pair of the fourth welding surfaces.

7. The developing cartridge according to claim 6, wherein the support member of the developing roller layer thickness regulating member further comprises:

a first part contacting the blade and a second part extending orthogonal to the first part.

8. The developing cartridge according to claim 6, wherein the second welding surfaces and the fourth welding surfaces are welded together where a width of the weld is less than widths of each of the second welding surface and the fourth welding surface.

9. The developing cartridge according to claim 6, wherein at least one of the second welding surfaces and the fourth welding surfaces includes a welding rib, and wherein the welding rib occupies less than all of the surface of the one of the second welding surfaces and the fourth welding surfaces.

10. The developing cartridge according to claim 6, wherein the second welding surfaces extend continuously from the first welding surface.

* * * * *